United States Patent [19]

Niemeyer

[11] 4,345,127

[45] Aug. 17, 1982

[54] HIGH-VOLTAGE, BLAST-ACTUATED POWER SWITCH HAVING A COLLAPSIBLE CONTACT

[75] Inventor: Lutz Niemeyer, Baden, Switzerland

[73] Assignee: BBC Brown, Boveri & Company, Ltd., Baden, Switzerland

[21] Appl. No.: 110,795

[22] Filed: Jan. 9, 1980

[30] Foreign Application Priority Data

Jan. 11, 1979 [CH] Switzerland ..... 245/79

[51] Int. Cl.[3] ..... H01H 33/70

[52] U.S. Cl. ..... 200/148 R; 200/144 R; 200/61.08

[58] Field of Search ..... 200/61.08, 148 R, 144 R

[56] References Cited

U.S. PATENT DOCUMENTS 3,848,100 11/1974 Kozorezov ..... 200/61.08

*Primary Examiner*—Robert S. Macon

*Attorney, Agent, or Firm*—Burns, Doane, Swecker & Mathis

[57] ABSTRACT

A high-voltage, blast-actuated power switch is disclosed which includes a sealed switch casing having a pair of electrical switch contacts, at least one of which can be collapsed by the pressure generated by a blasting cap. The switch casing is filled with a high dielectric strength medium having a low compressibility. When a short circuit or overload condition occurs, the blasting cap is ignited thereby generating a pressure wave. The pressure wave is transmitted through the medium and is practically instantaneously applied to the region of contact between the electric switch contacts. The electric switch contacts are deformed by the pressure wave and separate from each other. The switch contacts preferably include predetermined bending or breaking points to facilitate bending or breaking. The switch includes a screen which delays the gaseous materials emitted from the blasting cap from reaching the region between the separated electrical switch contacts. The screen is located between the blasting cap and the region of contact between the electrical switch contacts.

10 Claims, 1 Drawing Figure

HIGH-VOLTAGE, BLAST-ACTUATED POWER SWITCH HAVING A COLLAPSIBLE CONTACT

BACKGROUND OF THE INVENTION

In power transmission and distribution systems, rapid current rises can occur, such as those occurring during short-circuit conditions. In order to protect the high-voltage power lines against dynamic and thermal stresses which accompany the rapid current rises, the line must be electrically opened or cut-off before the short-circuit current has reached its first peak value if the line is carrying alternating current, or before the line has reached its final value if the line is carrying direct current. The cut-off time required, which depends upon the frequency of the alternating current and on the inductance, capacitance and resistance of the power line, should not exceed a few milliseconds. Such rapid cut-off times, however, cannot be obtained with mechanically or magnetically actuated switches in medium-voltage and high-voltage power networks. Therefore, switches have been developed which are actuated by blasting.

One conventional type of blast-actuated switch includes a torsion-rod spring having a contact projecting radially outward from its free end. The switch further includes a pull-rod which cooperates with a lever to place the torsion-rod spring under tension, and to press the elements fastened to the contact onto the main conductor line. The pull-rod has a recess into which a blasting cap is inserted. Upon the occurrence of a short circuit, the blasting cap is exploded, thereby causing the pull-rod to be torn apart. The lever is released and the contact elements are lifted away from the main conductor line as the torsion-rod spring contracts.

Another conventional type of blast-actuated switch includes a casing having a conductor arranged therein. The conductor includes a recess which accommodates a blasting cap. When the blasting cap is exploded, the conductor is directly torn apart.

Such conventional blast-actuated switches, however, have certain disadvantages. In the first mentioned type, the blasting cap is located outside of the region of the electric contacts and therefore does not influence the contacts directly. The separation of the contacts is accomplished exclusively by the spring force of the torsion-rod spring. Consequently, a significant time delay is experienced before the contacts are actually separated.

The second mentioned type of switch provides for a much shorter time delay than that of the first type. However, in the second type of switch, the gaseous materials emitted from the blasting cap as the cap explodes tearing apart the conductor, substantially lower the breakdown voltage across the ends of the blasted conductor, thereby substantially lowering the dielectric strength of the switch.

It is therefore an object of the present invention to provide a high-voltage, blast-actuated power switch in which the contacts are separated without auxiliary mechanical means, and in which the gaseous materials generated by the explosion of the blasting cap essentially does not penetrate the area between the separated contacts.

SUMMARY OF THE INVENTION

According to a preferred embodiment of the present invention, the high-voltage power switch includes a casing which is filled with a medium of low compressibility. The exploding blasting cap produces a pressure wave which is practically instantaneously transferred through the medium from the blasting cap to the electrical switch contacts. At least one of the two switch contacts is designed such that it will collapse when subjected to the pressure wave.

The present invention permits the pressure wave generated by the blasting cap to be transferred to the point of contact between the electrical switch contacts directly, and not through auxiliary mechanical devices. This arrangement, therefore, results in switch actuating speeds not feasible with conventional high-voltage, blast-actuated switches.

The medium transferring the pressure wave from the blasting cap to the electrical switch contacts will itself actively prevent the gaseous materials emitted from the blasting cap from reaching the region between the contacts during the critical time as the contacts separate from each other. Thus, breakdown voltage is not reduced by the gaseous material as in conventional blast-actuated switches.

A preferred embodiment of the present invention includes a screen which is arranged between the blasting cap and the region of contact between the electrical switch contacts. The screen prevents the gaseous materials emitted from the blasting cap from spreading in a straight line in the direction of the region of separation of the electric switch contacts.

According to the present invention, the medium which fills the switch casing has a low compressibility and a high dielectric strength. According to a preferred embodiment of the present invention, the medium is transformer oil. According to another preferred embodiment of the present invention, the medium is sulfur hexafluoride ($SF_6$).

BRIEF DESCRIPTION OF THE DRAWINGS

The preferred embodiments of the present invention are described with reference to the accompanying drawing wherein.

DESCRIPTION OF THE PREFERRED EMBODIMENTS

Figure 1:
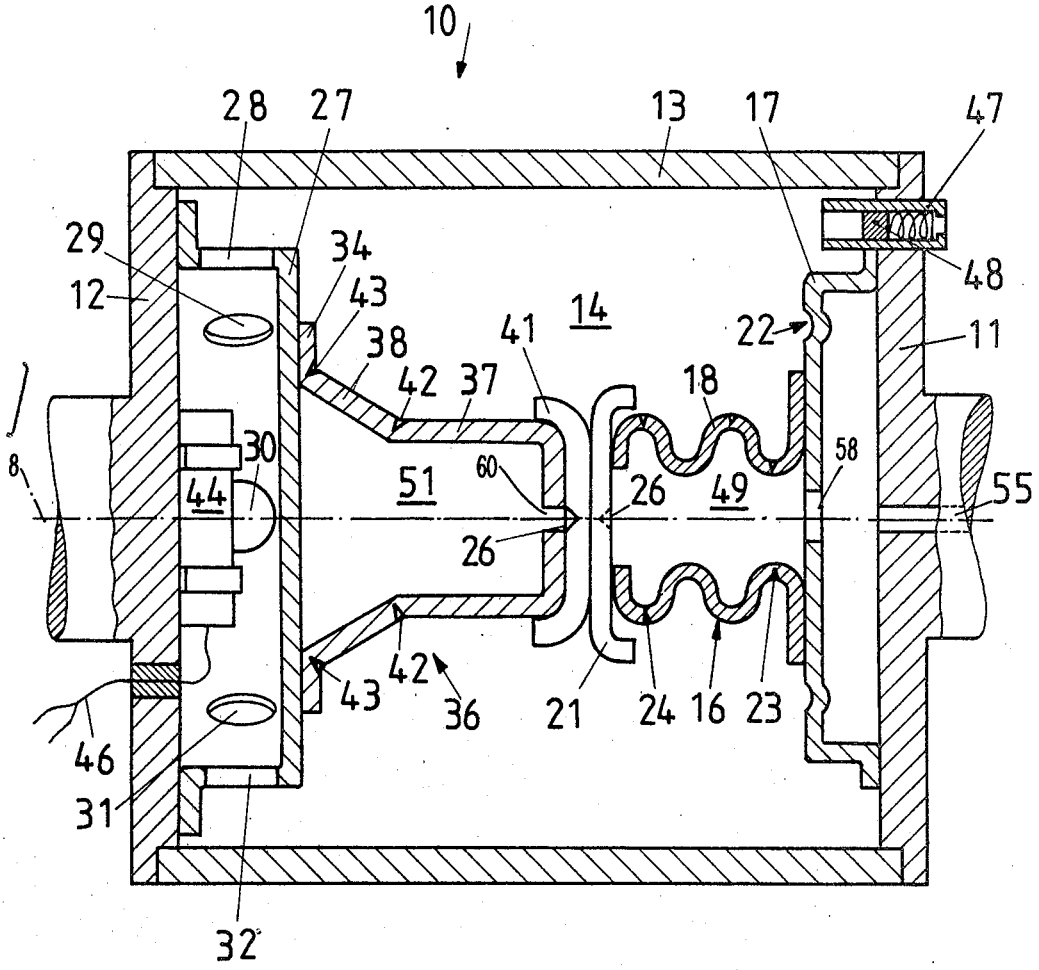
FIG. 1 is a cross-sectional view of a high-voltage, blast-actuated, power switch according to the present invention.

Referring to FIG. 1, a high-voltage, blast-actuated power switch 10 includes two external connections 11,12 which are mechanically connected to each other by a tube 13 made from an insulating material. The tube 13 is sealed to each of the external connections 11,12 so as to form a gas-tight and fluid-tight switch casing 14. The switch 10 is rotationally symmetric about an axis 8.

The switch 10 includes a first switch contact 16 which is soldered to the surface of the external connection 11 inside the switch casing 14. The first contact 16 has a curved base place 17 which is directly soldered onto the external contact 11; a corrugated tube 18 which is soldered onto the base plate 17; and a contact plate 21 which is soldered onto the corrugated tube 18.

The base plate 17 includes a corrugation 22 which is substantially coaxially situated about the axis 8. The corrugation 22 facilitates the resilient deflection of the center part of the base plate. The base plate also includes an aperture 58 which provides communication between a chamber 49 enclosed by the corrugated tube 18 and a bore 55 through the external connection 11.

The corrugated tube 18 is terminated at one end by the base plate 17, and is terminated at the other end by the contact plate 21. The corrugated tube 18 contains two punctures 23,24 which form predetermined bending points at which the mechanical strength of the corrugated tube is relatively low. The contact plate 21 contains a conical recess 26 at its center which forms a predetermined breaking point at which the mechanical strength of the contact plate is relatively low.

A second switch contact 36 is welded to a cup-shaped screen 27 which is in turn welded to the external connection 12 inside the casing. The screen 27 includes a rim which is directly welded to the external connection 12. The screen includes cylindrical sidewalls which have a plurality of large openings. Only some of the openings, specifically openings 28, 29, 30, 31 and 32, are illustrated in the figure.

A rim 34 of the second switch contact 36 is welded to an outer surface of the screen 27. The rim 34 is flanged outwardly. The switch contact 36 includes a cup-shaped part 37 having an aperture 60 substantially coaxially located about the axis 8. The second switch contact also includes a conical part 38 which forms a transition between the cup-shaped part 37 and the rim 34. A contact plate 41 is soldered onto the cup-shaped part 37.

The second switch contact 36 includes notches 42,43 coaxially disposed about the axis 8. The notches are located at the region of transition between the conical part 38 and the rim 34, and between the conical part 38 and the cup-shaped part 37. The notches 42,43 are predetermined bending points which increase the ability of the switch contact 36 to deform in the axially direction. The contact plate 41 contains a conical recess 26 at its center which forms a predetermined breaking point which lowers the mechanical strength of the contact plate 41.

The distance between the contact plate 21 and the surface of the external connection 11, and the distance between the contact plate 41 and the external connection 12 are dimensioned such that the contact plates 21, 41 are forced against each other after the switch is assembled with such a pressure that the contact resistance between the contact plates 21, 41 will be relatively small but yet the switch contacts 16, 36 are especially the predetermined breaking and bending points are not damaged. The contact plates 21, 41 may be soldered together so as to produce a practically resistance-free connection between the switch contacts 16, 36.

A blasting cap 44 is located within the region delimited by the external connection 12 and the cup-shaped screen 27. The blasting cap includes a pair of conductors 46 which permit the blasting cap to be electrically ignited. The conductors 46 are lead through the external connection 12 to the outside of the switch casing.

The entire switch casing 14 is filled with transformer oil which is practically incompressible and which has a high dielectric strength. A cylinder 47 with a relatively easily movable piston 48 is included in the external connection 11. The cylinder 47 is in communication with the transformer oil contained within the switch casing 14. The piston 48 moves within the cylinder 47 to compensate for any expansion or contraction of the transformer oil caused by temperature changes.

In the event the high-voltage power network becomes overloaded, the blasting cap 44 is ignited. The blasting cap generates a pressure wave which is transmitted through the transformer oil. The two switch contacts 16, 36 are subjected on all sides to the pressure wave transmitted through the transformer oil. The switch contacts will collapse, and the contact plates 21, 41 will be torn apart within approximately 10 microseconds. Since the transformer oil penetrates the region between the switch contacts, the transformer oil will normally prevent any arcing or will quench an arc within a very short time after the arc ignites.

Unavoidably, gases are generated by the blasting cap as the blasting cap explodes. The gases are deflected by the screen 27 toward the surrounding tube 13, and will reach the region between the separated contact plates only sometime after the plates have already separated and the potential originally applied to the external connections 11,12 has been removed by some additional less rapidly switching device. Additionally, the transformer oil itself will permit the pressure wave to be rapidly transmitted from the blasting cap to the contact plates 21, 41, but will prevent the gases from rapidly reaching the contact plates.

The pressure wave generated by exploding the blasting cap travels through the transformer oil relatively quickly because the transformer oil is a relatively incompressible medium. As the pressure wave travels from the blasting cap toward the external connection 11, the second switch contact 36 is deformed in the axially direction bending at the notches 42, 43. The pressure wave causes the conical recess 26 contained in the contact plate 41 to break forming an opening through which the medium can flow from the switch casing 14 into a chamber 51 enclosed by the second switch contact 36.

The pressure wave also causes the conical recess 26 contained in the contact plate 21 to break forming an opening through which the medium can flow into the chamber 49 of the first switch contact 16. The advancing pressure wave further causes the corrugated tube 18 to bend at punctures 23, 24.

The pressure generated by the explosion is quickly reduced as the switch contacts collapse and the relatively incompressible medium flows from the switch casing 14 into chambers 49, 51 through the openings 26. Therefore, the tube 13 of the casing is subjected to a pressure load for only a brief period of time.

A switch according to the present invention need not be rotationally symmetric. The switch casing may be spherical, cubical or rectangular. Additionally, transformer oil need not be used as the relatively incompressible mediun. Other relatively incompressible mediums having high dielectric strength can be used, such as sulfur hexafluoride ($SF_6$) which has been liquefied under pressure.

A switch according to the present invention can also be operated by means of a quenching device which is connected in parallel with the switch and which contains a fusible element. Such arrangements are known to those skilled in the art. Additionally, devices for determining the existence of over-currents or short-circuits within the main conductor in order to generate the ignition voltage for the blasting cap are also well known in the art.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. A high-voltage, blast-actuated power switch comprising:

a switch casing having first and second electrically conductive external connections electrically insulated from each other and having a hollow chamber, said chamber being substantially filled with a high dielectric strength medium having low compressibility;

first and second switch contacts included in said hollow chamber, said first switch contacts being electrically connected to said first external connection and said second switch contact being electrically connected to said second external connection, said first and second switch contacts being in physical and electrical contact with each other thereby electrically connecting said first external connection to said second external connection; and blasting cap means for generating and applying a pressure wave to said medium contained in said switch casing and spaced from said switch contacts;

wherein said pressure wave travels through said medium from said blasting cap means to said first and second switch contacts, and being subject to said pressure wave at least one of said first and second switch contacts collapses thereby electrically disconnecting said first external connection from said second external connection.

2. The switch according to claim 1 wherein at least one of said first and second switch contacts has a hollow region and has collapsing means for collapsing said at least one contact when said at least one contact is subjected to said pressure wave.

3. The switch according to claim 2 wherein said collapsing means comprises a predetermined bending point.

4. The switch according to claim 1 wherein at least one of said first and second switch contacts comprises a corrugated tube, the corrugations of which urge said at least one contact against the other contact.

5. The switch according to claim 1 wherein said first and second switch contacts are soldered to each other.

6. The switch according to claim 1 wherein said blasting cap means emits a gaseous material when actuated and said switch further comprises means for shielding the region of physical contact between said first and second switch contacts from said gaseous material emitted by said blasting cap means.

7. The switch according to claim 6 wherein said blasting cap means includes a blasting cap located within said hollow chamber of the switch casing, and wherein said means for shielding includes a screen located within said hollow chamber such that said screen covers at least a portion of said blasting cap.

8. The switch according to claim 1 wherein said medium is transformer oil.

9. The switch according to claim 1 wherein said medium is an electro-negative fluid.

10. The switch according to claim 1 wherein said medium is condensed sulfur hexafluoride.

* * * * *